US008057061B2

(12) United States Patent
Otsuki et al.

(10) Patent No.: US 8,057,061 B2
(45) Date of Patent: Nov. 15, 2011

(54) SHOWCASE

(75) Inventors: Atsuo Otsuki, Gunma-ken (JP); Yoichi Amari, Ota (JP); Tetsuya Oketani, Ota (JP); Sakumi Shibusawa, Ota (JP)

(73) Assignee: Sanvo Electric Co., Ltd., Moriguchi-shi (JP)

( * ) Notice: Subject to any disclaimer, the term of this patent is extended or adjusted under 35 U.S.C. 154(b) by 226 days.

(21) Appl. No.: 12/370,178

(22) Filed: Feb. 12, 2009

(65) Prior Publication Data

US 2009/0207592 A1 Aug. 20, 2009

(30) Foreign Application Priority Data

Feb. 19, 2008 (JP) ..... 2008-37102

(51) Int. Cl.
*A47F 11/10* (2006.01)

(52) U.S. Cl. ..... 362/125; 362/249.02; 362/241; 362/247

(58) Field of Classification Search ..... 362/294, 362/125–126, 311.02, 355–356, 217.02, 362/218, 311.03, 246, 221, 249.02, 247, 362/245, 241

See application file for complete search history.

(56) References Cited

U.S. PATENT DOCUMENTS

| | | | | |
|---|---|---|---|---|
| 7,513,637 | B2 * | 4/2009 | Kelly et al. | 362/126 |
| 7,572,027 | B2 * | 8/2009 | Zampini et al. | 362/225 |
| 7,824,056 | B2 * | 11/2010 | Madireddi et al. | 362/125 |
| 2002/0191396 | A1 * | 12/2002 | Reiff et al. | 362/246 |
| 2007/0171647 | A1 * | 7/2007 | Artwohl et al. | 362/276 |
| 2007/0195535 | A1 * | 8/2007 | Artwohl et al. | 362/341 |

FOREIGN PATENT DOCUMENTS

| | | |
|---|---|---|
| JP | 8-224150 | 9/1996 |
| JP | 2546302 | 5/1997 |

* cited by examiner

*Primary Examiner* — Robert May
(74) *Attorney, Agent, or Firm* — Krantz, Quintos & Hanson, LLP

(57) ABSTRACT

An object is to provide a showcase capable of improving the appearance of an illumination apparatus itself and improving the illumination effect produced by the illumination apparatus. In the showcase in which the inside of a display chamber disposed in a main body is illuminated by an illumination apparatus, the illumination apparatus includes an LED illumination member having an LED element, and a holding member attached to the main body to hold the LED illumination member, and the holding member includes a lead wire receiving portion for receiving a lead wire of the LED illumination member.

6 Claims, 5 Drawing Sheets

SHOWCASE

BACKGROUND OF THE INVENTION

The present invention relates to a showcase in which the inside of a display chamber disposed in a main body is illuminated by an illumination apparatus.

DESCRIPTION OF THE RELATED ART

Heretofore, in a showcase of this kind, particularly in a showcase in which a front opening of a display chamber is openably closed by a see-through door and illumination devices are vertically attached to a main body inwardly from the edge of an opening, a vertical pillar is disposed at the center of a front opening edge or on each side of the opening edge, and a fluorescent lamp is attached to the rear surface of this pillar to illuminate the inside of the display chamber from the front side (e.g., see Japanese Patent Application Laid-Open No. 8-224150 (Patent Document 1) and Japanese Utility Model Registration No. 2546302 (Patent Document 2)).

However, the fluorescent lamp used as an illumination apparatus in the conventional showcase has to be replaced owing to a decrease in luminance or a fault of lighting due to aging. As a result, a user is forced to perform a replacement work of the fluorescent lamp, which causes a problem that the work is cumbersome. In addition, a new fluorescent lamp needs to be always stored for the replacement, and a place for storing the fluorescent lamp needs to be secured. Further, the fluorescent lamp contains mercury, which causes a problem that the used fluorescent lamp cannot easily be discarded.

In addition, parts such as a socket and a stabilizer are necessary for attaching the fluorescent lamp in the display chamber, and hence in the attachment position, attachment places for not only the fluorescent lamp but also the socket, the stabilizer and the like also need to be secured. Moreover, lead wires must be connected to the respective fluorescent lamps for power supply thereto, which causes problems that assembly workability is poor and that the number of the parts, and production cost increase. Furthermore, the fluorescent lamps use an alternate current, and hence flicker, which causes a problem that eyes are adversely affected.

For the above reasons, in recent years, an illumination apparatus using LED elements is adopted as means for illuminating the inside of the display chamber. At this time, the lead wires for supplying the power to each LED element are arranged on the side of a substrate to which the LED element is to be attached, and the lead wires are hidden together with the LED elements by a shade.

However, the shade is made of a translucent, colorless and transparent material to secure light transmittance, the lead wires are therefore seen through the shade from the outside, and there is a problem of marring appearance. Particularly in the illumination apparatus using the LED elements, unlike the fluorescent lamps, the apparatus is provided on the substrate, and it is therefore difficult to hide the lead wires from the outside by the illumination apparatus itself. Moreover, when the LED illumination apparatus is constituted of a plurality of LED illumination members and the illumination members are provided so that their attachment positions can be freely changed, there is inconvenience that the lead wires disturb a position changing work.

Further in the illumination apparatus using the LED elements, unlike the fluorescent lamps, chip type LED elements are longitudinally arranged in rows. Thus, light passing through the shade is constituted by the rows of intense point light sources, and is inconveniently glaring.

SUMMARY OF THE INVENTION

The present invention has been developed to solve the conventional technical problems. An object of the present invention is to provide a showcase capable of improving the appearance of an illumination apparatus itself and improving an illumination effect produced by the illumination apparatus.

According to a first aspect of the invention, there is provided a showcase in which the inside of a display chamber disposed in a main body is illuminated by an illumination apparatus, characterized in that the illumination apparatus includes an LED illumination member having an LED element, and a holding member attached to the main body to hold the LED illumination member, and the holding member includes a lead wire receiving portion to receive a lead wire of the LED illumination member.

A showcase of a second aspect of the invention is characterized in that in the first aspect of the invention, the LED illumination member includes a plurality of LED elements arranged in a row, a shade is attached to the holding member at a position in an irradiating direction of light from the LED elements, and the shade has a wave-like sectional shape extending in the longitudinal direction of the row of the LED elements.

A showcase of a third aspect of the invention is characterized in that in the second aspect of the invention, the sectional shape of a portion of the shade positioned at the end of the illumination apparatus is a wave-like shape which more noticeably refracts the light from the LED elements in the longitudinal direction of the row of the LED elements as compared with the sectional shape of the other portion.

A showcase of a fourth aspect of the invention is characterized in that in the second or third aspect of the invention, the holding member is provided with a pair of reflectors positioned on both sides of an irradiation path of the light from the LED elements to the shade so that the reflectors are disposed away from each other as a distance from the LED elements increases.

A showcase of a fifth aspect of the invention is characterized in that in the above aspects of the invention, the LED illumination member includes a substrate provided with the plurality of LED elements on the surface thereof, the holding member is made of a metal, and the holding member is provided with radiation ribs which abut on positions corresponding to the backsides of the LED elements on the back surface of the substrate.

According to the first aspect of the present invention, in the showcase in which the inside of the display chamber disposed in the main body is illuminated by the illumination apparatus, the illumination apparatus includes the LED illumination member having the LED element, and the holding member attached to the main body to hold the LED illumination member, and the holding member includes the lead wire receiving portion to receive the lead wire of the LED illumination member. Therefore, the lead wire of the LED illumination member can easily be received in the lead wire receiving portion of the holding member.

In consequence, it is possible to eliminate a disadvantage that the lead wire is carelessly pulled during maintenance of the LED illumination member or the like, whereby safety can be improved. Furthermore, the lead wire can be hidden to improve appearance.

According to the second aspect of the invention, in addition to the first aspect of the invention, the LED illumination member includes the plurality of LED elements arranged in the row, the shade is attached to the holding member at the position in the irradiating direction of the light from the LED elements, and the shade has a wave-like sectional shape extending in the longitudinal direction of the row of the LED elements. Therefore, intense irradiation light from the LED elements can be diffused by the shade. Moreover, the shade refracts the light in the longitudinal direction of the row of the LED elements, and hence the feeling of discontinuity of the light can be reduced. In consequence, the appearance can be improved.

According to the third aspect of the invention, in addition to the second aspect of the invention, the sectional shape of the portion of the shade positioned at the end of the illumination apparatus is the wave-like shape which more noticeably refracts the light from the LED elements in the longitudinal direction of the row of the LED elements as compared with the sectional shape of the other portion. Therefore, the light of the end of the illumination apparatus can noticeably be refracted in the longitudinal direction. For example, in the case that the shade is vertically attached, bright illumination of a portion near a ceiling can be realized.

According to the fourth aspect of the invention, in addition to the second or third aspect of the invention, the holding member is provided with the pair of reflectors positioned on both the sides of the irradiation path of the light from the LED elements to the shade so that the reflectors are disposed away from each other as the distance from the LED elements increases. Therefore, the irradiation light from the LED elements can be reflected by the reflectors to effectively illuminate the inside of the display chamber.

According to the fifth aspect of the invention, in the respective aspects of the invention, the LED illumination member includes the substrate provided with the plurality of LED elements on the surface thereof, the holding member is made of the metal, and the holding member is provided with the radiation ribs which abut on the positions corresponding to the backsides of the LED elements on the back surface of the substrate. Therefore, heat from the LED elements can smoothly be radiated through the metal holding member. In consequence, deterioration and failure of the LED illumination member can be prevented or suppressed.

DETAILED DESCRIPTION OF THE EMBODIMENTS

Figure 1:
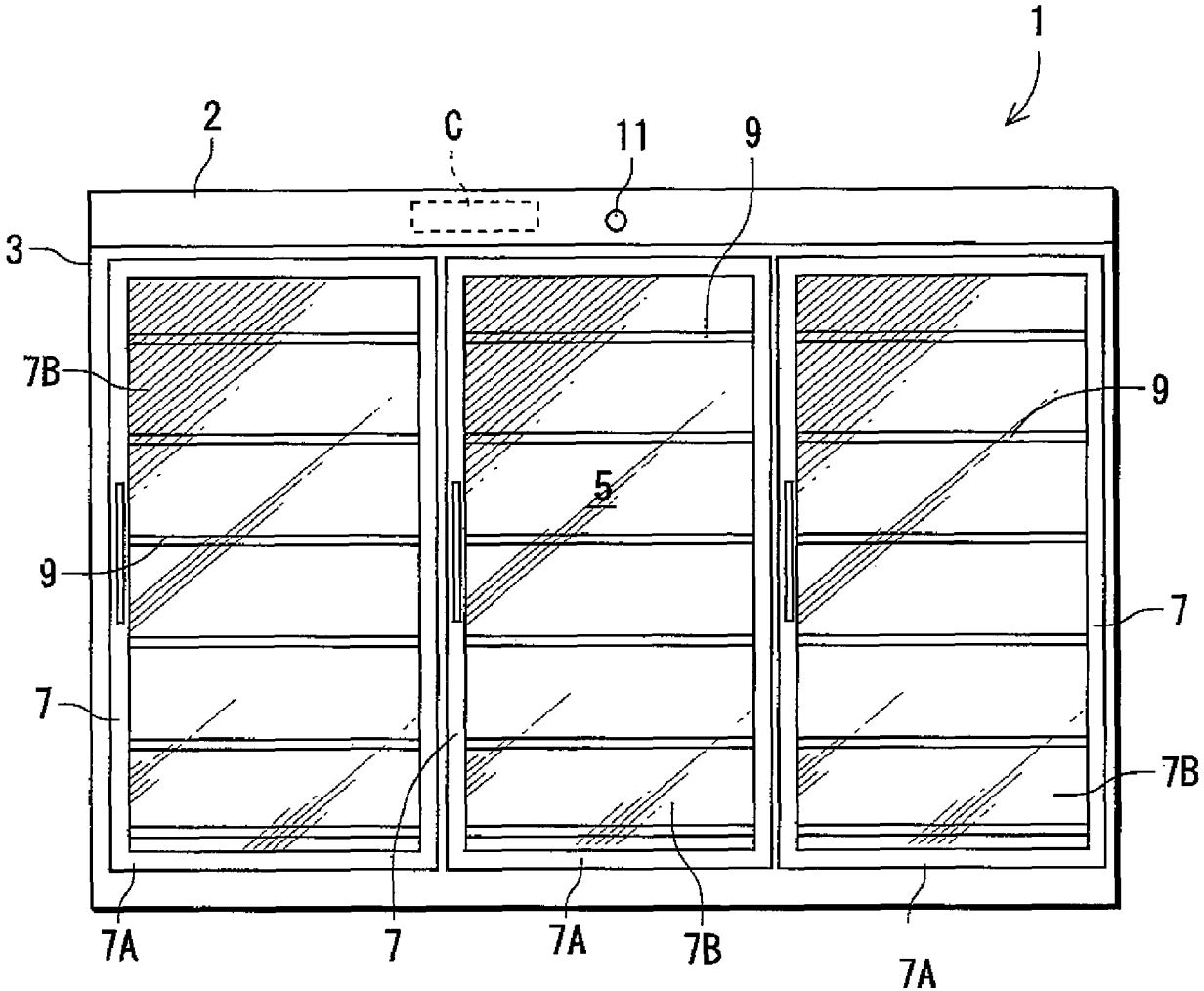
FIG. 1 is a front view of a showcase to which the present invention is applied.
Figure 2:
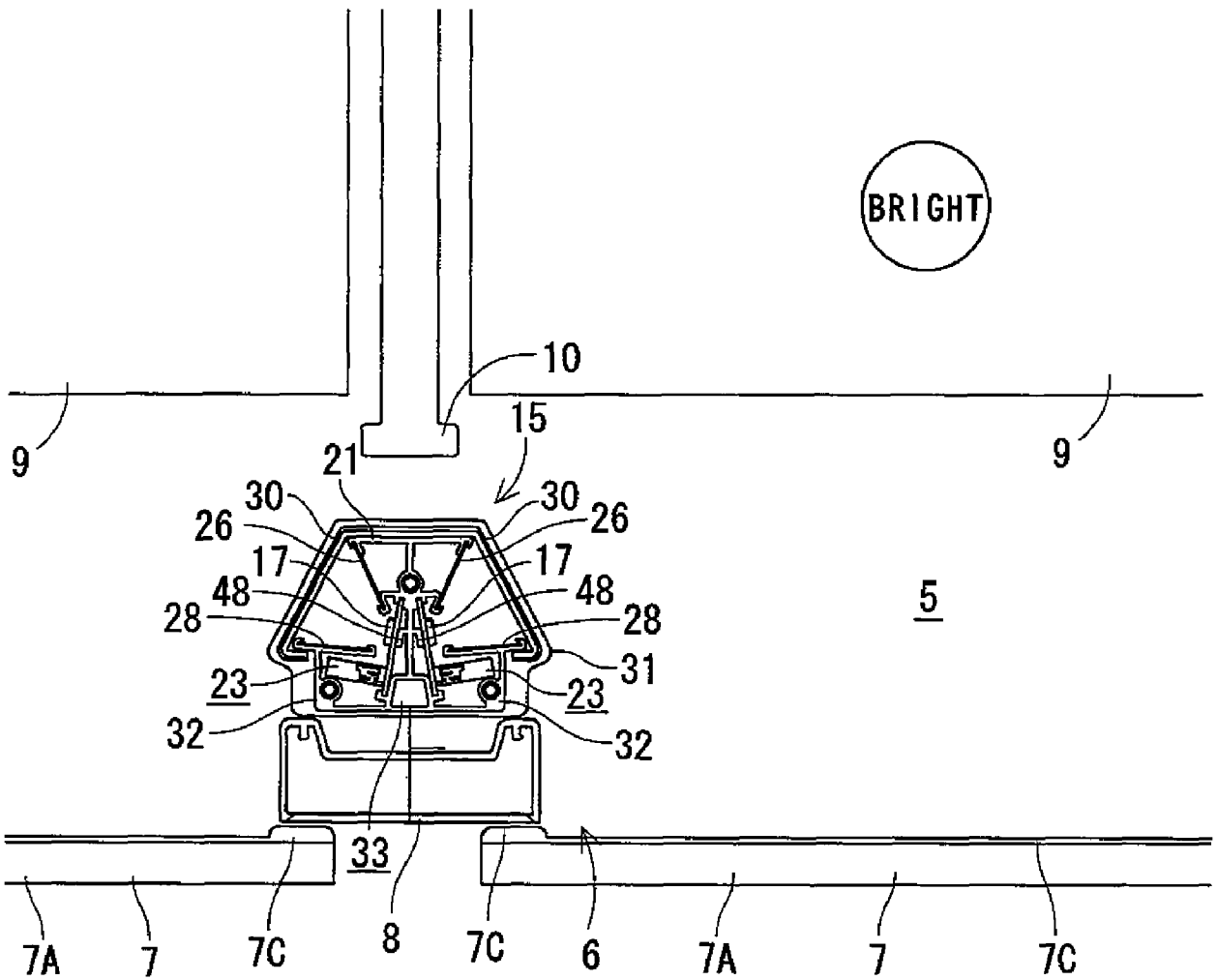
FIG. 2 is a partially enlarged sectional view of the showcase of FIG. 1.

Hereinafter, an embodiment of the present invention will be described in detail with reference to the drawings. FIG. 1 shows a front view of a showcase 1 to which the present invention is applied, and FIG. 2 shows a partially enlarged sectional view of the showcase 1. The showcase 1 is a low-temperature showcase to be installed in a supermarket, a convenience store or the like, and a main body is constituted by an insulating box member (an insulating wall) 2 whose front face is open.

The insulating box member 2 is constituted of an outer box 3 made of steel plates and opened at the front face thereof; a unshown inner box made of steel plates or a hard resin, opened at the front face thereof and incorporated in the outer box 3 with a space left therein; and an insulating material made of foamed polyurethane charged in a foamed state between the outer box 3 and the inner box.

A display chamber 5 is disposed in this inner box, and a front opening 6 of the display chamber 5 is openably closed from its upper end to its lower end by a plurality (three in this embodiment) of pivoted glass doors 7 through which the inside can be seen. Each glass door 7 is made up of a frame 7A forming edges of the door; and a glass plate 7B, through which the inside can be seen, attached to the frame 7A. A gasket 7C is provided on the rear surface of the frame 7A.

A plurality (two in this embodiment because three doors 7 are provided) of pillars 8 are vertically provided at predetermined intervals on an edge of the front opening 6 of the insulating box 2. Such a pillar 8 is a columnar member made of, for example, an insulating material. Each glass door 7 seals the inside of the display chamber 5 in a state in which the gasket 7 on the rear surface comes into close contact with the edges of the front opening 6 and the front surface of the corresponding pillar 8.

Shelf pillars 10 are vertically provided at the back face and the front portion of the display chamber 5. A plurality of shelves 9 are set on the shelf pillars 10. A plurality of engagement holes are formed at predetermined intervals in each shelf pillar 10. By changing the engagement hole to which the shelf 9 is set, the vertical position of the shelf 9 can be changed.

In this embodiment, the shelf pillars 10 are provided at the back face and the front portion of the display chamber 5 behind the pillars 8. Thus, a plurality of shelves 9 are set behind each glass door 7.

Moreover, an unshown cooler and an unshown blower of a cooling system are provided in the upper portion of the display chamber 5. The cooler cooperates with an unshown compressor, an unshown condenser and the like separately provided, to constitute the cooling system making up a so-called refrigeration cycle. Cold air from the cooler is forcedly circulated through the display chamber 5 by the blower to cool the inside of the display chamber 5 to a predetermined temperature.

Figure 3:
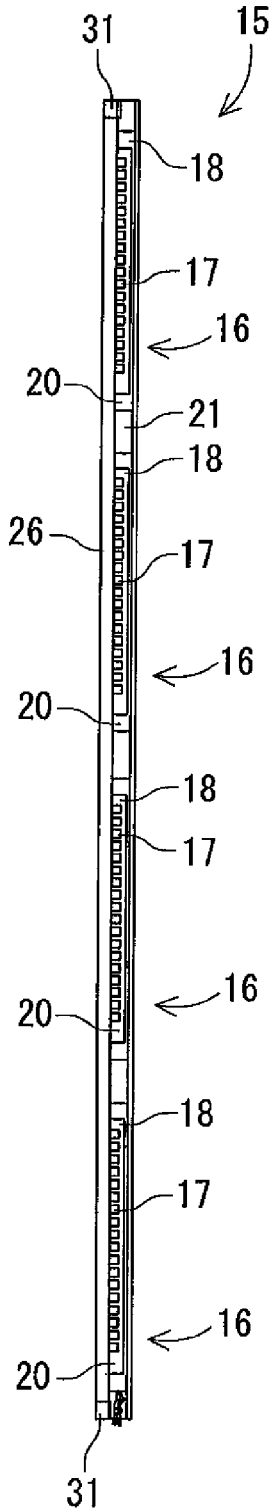
FIG. 3 is a front view of LED elements of an illumination apparatus.
Figure 4:
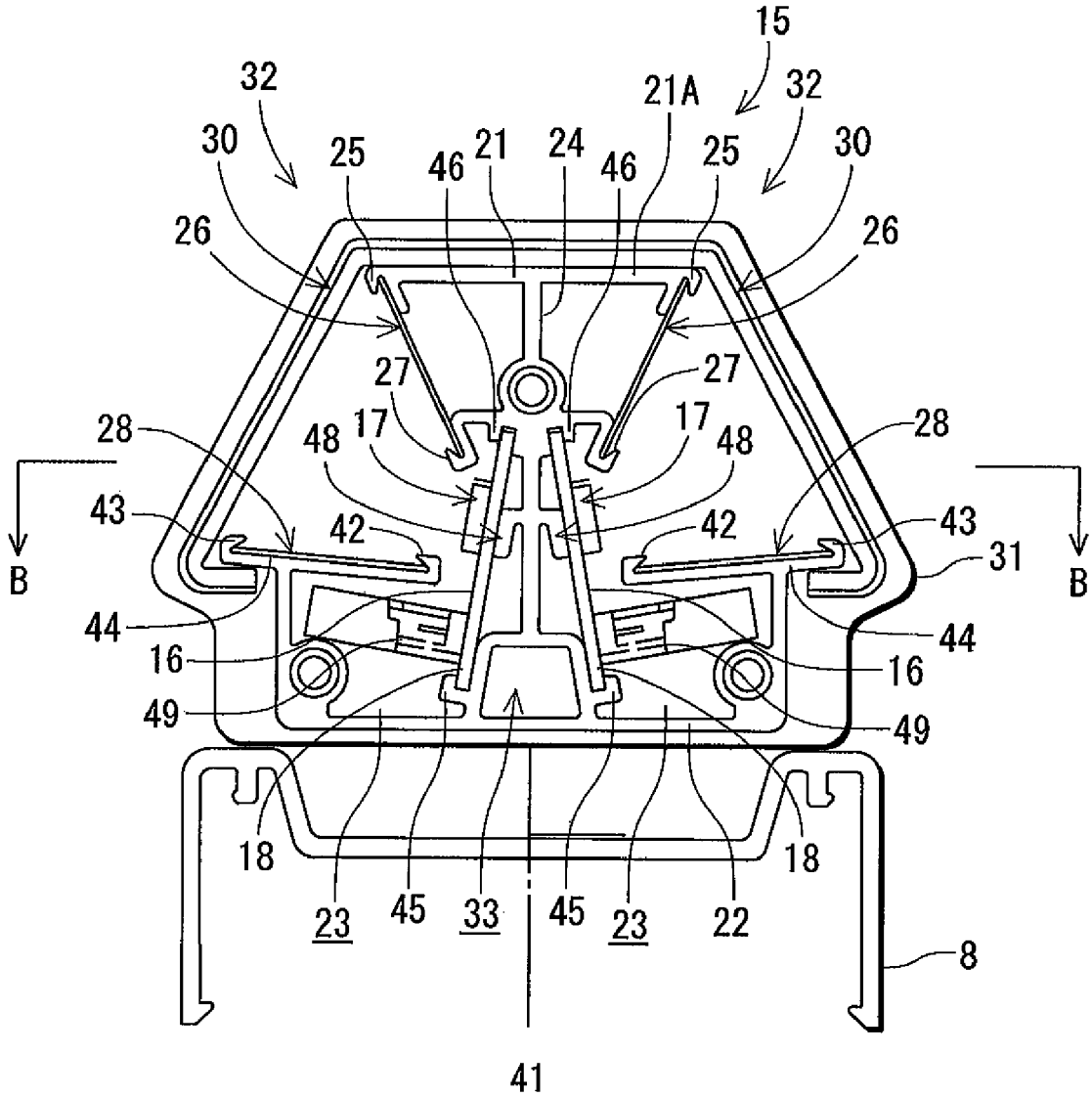
FIG. 4 is a cross-sectional view of the illumination apparatus provided on a pillar.
Figure 5:
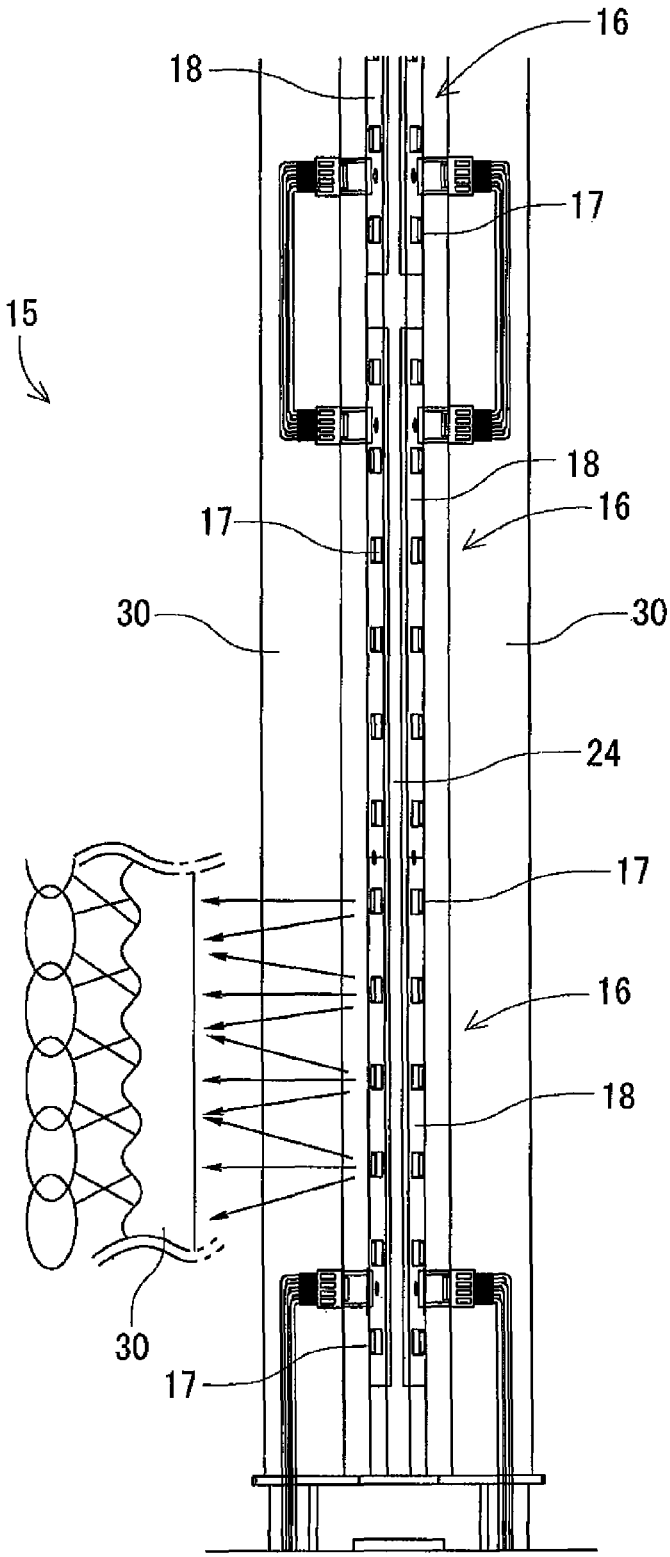
FIG. 5 is a sectional view cut along the line B-B of FIG. 4, showing a sectional shape of a shade of the illumination apparatus.

Next, an illumination apparatus 15 provided in the display chamber 5 will be described in detail with reference to FIGS. 2 to 4. FIG. 3 shows a front view of LED elements in the illumination apparatus 15. FIG. 4 shows a cross-sectional view of the illumination apparatus 15 provided on the pillar 8. FIG. 5 shows a sectional view cut along the line B-B of FIG. 4, showing a sectional shape of a shade 30 of the illumination apparatus 15.

In this embodiment, the illumination apparatuses 15 are vertically provided inwardly from the edge of the opening 6 of the insulating box 2 constituting the main body, more specifically, at the front corners of the display chamber 5 and on the rear surface of each pillar 8. Each illumination apparatus 15 is made up of a plurality of LED illumination members 16; a holding member 21 attached inwardly from the edge of the opening 6 of the insulating box 2 to hold the LED illumination members 16; the shade 30; and a cover member 31.

Each LED illumination member 16 is constituted by a substrate 18 provided with a plurality of LED elements 17. The substrate 18 extends in a longitudinal direction. A plurality of LED elements 17 are attached to the substrate 18 at predetermined intervals in a row. In this embodiment, each LED element 17 is a chip type white LED element.

The holding member 21 extends vertically with respect to the front opening 6 of the insulating box 2, and the holding member is made of a metal having satisfactory heat conductivity, for example, an aluminum material. The front wall of the holding member 21 serves as an attachment surface 22 to be brought into contact with and attached to the rear surface of the pillar 8. In this embodiment, to illuminate both lateral directions (both obliquely backward directions), the holding member 21 has a shape in which two holding portions 32, 32 each having a substantially U-shaped section are united back to back. The holding member 21 is linearly symmetric with respect to a partition wall 24 formed along an axis 41 so as to extend in a front-to-rear direction at the center of the holding member.

A radiation passage 33 is formed inside a front portion of the partition wall 24. On both surfaces of the front portion of the partition wall 24 constituting the radiation passage 33, illumination holding portions 45 are formed to detachably engage with and hold the front ends of the LED illumination members 16. On both surfaces of a rear portion (from the center) of the partition wall 24, illumination holding portions 46 are formed to detachably engage with and hold the rear ends of the LED illumination members 16 in cooperation with the illumination holding portions 45.

Here, the radiation passage 33 is formed to ensure a predetermined space inside both the faces of the front portion of the partition wall 24. Therefore, each LED illumination member 16 is attached to the illumination holding portions 45 and 46 of the partition wall 24 so that the rear end of the LED illumination member is nearer to the axis 41 than the front end thereof. Thus, the LED illumination member 16 is attached so as to face not laterally but somewhat backward at a predetermined angle.

On both the side surfaces of the partition wall 24 positioned between the illumination holding portions 45 and 46, radiation ribs 48, 48 are formed integrally with the partition wall 24 so as to abut on the backsides of the LED illumination members 16 attached to the partition wall.

Inside the front portions of the front walls of the holding portions 32 on both sides of the radiation passage 33, lead wire receiving portions 23 are formed to receive lead wires 49 for supplying power to the LED elements 17 of the LED illumination members 16.

On the front wall of the holding portion 32 positioned behind the lead wire receiving portion 23, a reflector holding portion 44 is formed to extend from the partition wall 24 side to the opening. At both ends of the reflector holding portion 44, engagement portions 42, 43 are formed to hold one reflector 28. On the other hand, on both side surfaces of the partition wall 24, engagement portions 27 are formed to hold another reflector 26 in cooperation with engagement claws 25 formed at ends of the rear walls 21A of the holding portions 32.

At this time, the engagement portions 27 and 42 are formed close to the LED elements 17 held by the holding member 21, that is, at positions where an irradiation path for guiding irradiation light from the LED element 17 to the opening portion of the holding portion 32 is not blocked. In each holding portion 32, the front wall in which the opening portion is formed is longer than the rear wall 21A.

In consequence, a pair of reflectors 26 and 28 attached to the engagement portions 25 and 27 and the engagement portions 42 and 43, respectively, are positioned on both sides of the LED element 17 and the irradiation path of the light from the LED element 17 extending from the side of the element to the opening portion open somewhat backward. As a distance from the LED element 17 increases, the reflectors are disposed away from each other.

On the outer periphery of the holding member 21, the shade 30 made of a translucent, colorless and transparent material or a lacteous material is attached so as to cover the opening portions and the rear walls 21A of both the holding portions 32. In this embodiment, the shade 30 is detachably engaged with the front surface of the engagement portion 43 (the surface on the pillar 8 side) formed at an end of the front wall of each holding portion 32, and the shade is fixed to the holding member 21 with unshown ornamental screws.

Here, as shown in the enlarged sectional view of the shade 30 of FIG. 5, the shade 30 provided at the opening portion of the holding member 21 in an irradiating direction of the light from each LED element 17 has such a sectional shape that the surface of the shade opposite to the LED elements 17 has a wave-like shape extending in the longitudinal direction of the row of the LED elements 17.

Particularly in this embodiment, the wave-like sectional shape of the shade 30 positioned in the upper and lower portions of the display chamber 5 from the central portion of the display chamber 5 is a wave-like shape that noticeably refracts the light in the longitudinal direction of the row of the LED elements 17 (in this case, the upper portion of the shade refracts the light further upwardly, and the lower portion of the shade refracts the light further downwardly).

In this embodiment, the shade has the wave-like sectional shape extending in the longitudinal direction of the row of the LED elements 17, that is, the LED illumination member 16. However, the shape is not limited to the wave-like shape. A shape that is concavo-convex at a predetermined frequency, for example, a saw-tooth-like shape may be used. Moreover, the wave-like sectional shape is formed on the surface of the shade opposite to the LED elements 17. However, the present invention is not limited to this example. The surface of the shade on the side of the LED elements 17, both the surfaces of the shade, or the whole shade 30 may have a series of wave-like sectional shape.

Moreover, as shown in FIG. 3, the upper and lower ends of the holding member 21 are closed with the cover member 31. It is to be noted that the cover member 31 is provided with unshown connection holes for circulating cold air therethrough.

The procedure of attaching the illumination apparatus 15 having such a constitution will be described. The substrate 18 to which the LED elements 17 are attached is engaged with the illumination holding portions 45, 46 of the holding member 21 and fixed. At this time, the back surface of the substrate 18 at the positions corresponding to the backsides of the LED elements 17 abuts on the radiation rib 48 formed on the partition wall 24 of the holding member 21.

The lead wires 49 extending out of the substrate 18 of the LED illumination member 16 are easily received in the lead wire receiving portion 23 formed in the front portion of the front wall of the holding member 21.

Then, the one reflector 28 is engaged with the engagement portions 42, 43 of the reflector holding portion 44 of the holding member 21, and fixed. Moreover, the other reflector 26 is engaged with the holding portions 25, 27, and fixed. In consequence, the lead wires received in the lead wire receiving portion 23 are hidden by the reflector holding portion 44 and the reflector 28.

It is to be noted that in this embodiment, a plurality of LED illumination members 16 described above are attached to the holding member 21. Alternatively, the illumination apparatus 15 may be constituted by a single LED illumination member 16 extending between the upper and lower ends of the front opening 6. However, when the apparatus is constituted by a plurality of LED illumination members 16 as in this embodiment, production cost can be reduced and handling properties can be improved.

Then, the shade 30 is attached to the opening portions of the holding portions 32, 32 of the holding member 21 to cover the LED illumination members 16 received inside.

Afterward, the holding member 21 to which the LED illumination members 16 have been attached is attached to the rear surface of the pillar 8. In this embodiment, since the illumination apparatuses 15 are attached and positioned on both sides of each glass door 7, a holding member constituted by a single holding portion 32 providing an opening portion only in one direction is attached to each of both front corners of the display chamber 5. At this time, the illumination apparatus 15 to be provided in each front corner is attached so that the irradiation light from the LED elements 17 is radiated toward the inside of the display chamber 5.

In the above-described constitution, the light from the LED elements 17 of the LED illumination member 16 fixed to each holding portion 32 of the holding member 21 is radiated laterally (substantially parallel to the glass door 7) from the rear portion of each side of the glass door 7. In this embodiment, with respect to the partition wall 24 provided substantially perpendicularly to the back surface of the pillar 8, the LED illumination member 16 is provided to be somewhat inclined backward (to the display chamber 5 side). In consequence, since the light from the illumination apparatus 15 is radiated toward the front portions of the shelves 9 set in the display chamber 5, the highly directional light from the LED elements 17 can be radiated toward the front portions of the shelves 9. Thus, commodities on the shelves 9, in particular, the commodities at the forefront can be evenly well illuminated, and the front faces of the commodities can be effectively illuminated. Consequently, the illumination effect and the display effect of the commodities can be improved.

In addition, since the shade 30 provided at the position in the irradiating direction of the light from the LED elements 17 has a wave-like sectional shape extending in the longitudinal direction (the vertical direction in the present embodiment) of the row of the LED elements 17, intense irradiation light from the LED elements 17 can be diffused by the shade 30, and thus glare can be reduced. In addition, since the wave-like sectional shape of the shade 30 refracts the light in the longitudinal direction of the row of the LED elements 17, the row of the light from the LED elements 17 as point light sources can be viewed as light from a linear light source. Thus, the feeling of discontinuity of the light, further, the concentration of the illuminance of the light source can be reduced. In consequence, the appearance can be improved.

Particularly in this embodiment, as described above, the portions of the shade 30 positioned at the ends of the illumination apparatus 15, that is, the upper and lower portions of the shade 30 have a wave-like sectional shape which more noticeably refracts the light from the LED elements 17 in the longitudinal direction of the row of the LED elements 17 as compared with the sectional shape of the other portion.

The sectional view of the shade 30 of FIG. 5 shows a section of a portion of the shade 30 corresponding to the upper portion of the display chamber 5, for example, a portion between the ceiling of the display chamber 5 and the uppermost shelf 9. A state is shown in which the irradiation light from the LED elements 17 (solid arrows) is incident from the surface of the shade 30 on the LED element 17 side, and refracted at respective angles by the portion of the wave-like shape of the surface of the shade 30 opposite to the LED elements 17. As described herein, as to the light refracted from the surface of the shade 30, the light from the surface of the upper portion of the shade is refracted in a further upward direction.

Thus, the light of the upper portion of the illumination apparatus 15 can be noticeably refracted upward while the light of the lower portion of the illumination apparatus 15 can be noticeably refracted downward. This can realize bright illumination to a portion of the display chamber 5 near the ceiling or floor. In consequence, the whole display chamber 5 can be more brightly illuminated, and the inside of the display chamber 5 can be widely seen.

In this embodiment, a pair of reflectors 26 and 28 are attached to the holding portions 32, 32 of the holding member 21 on both sides of the irradiation path of the light from the LED elements 17 to the shade 30 (the opening portion) so that the reflectors are disposed away from each other as the distance from the LED elements 17 increases. Therefore, the irradiation light from the LED elements 17 can be reflected by these reflectors 26, 28 to effectively illuminate the inside of the display chamber 5.

The inside of the display chamber 5 is illuminated with the irradiation light from the LED elements 17 through the shade 30, but at this time, since the lead wires 49 of the LED illumination member 16 are received in the lead wire receiving portion 23 formed in the holding member 21, the disadvantage that the lead wires 49 are seen through the shade 30 can be avoided, and the appearance can be improved.

In addition, the disadvantage that the lead wire 49 is carelessly pulled during maintenance of the LED illumination member 16 or the like can be eliminated, and safety can thus be improved.

The holding member 21 to which the LED illumination member 16 is attached is made of a metal having satisfactory thermal conductivity, and the holding member 21 is provided with the radiation ribs 48 which abut on the back surface of the substrate 18 at the positions corresponding to the backsides of the LED elements 17. Therefore, waste heat from the substrate 18 that generates the heat by power supply to the LED elements can be smoothly radiated through the metal holding member 21. Thus, deterioration and failure of the LED illumination member can be prevented or suppressed. Since the cold air circulated through the display chamber 5 can be circulated through the radiation passage 33 formed in the holding member 21 and the connection holes 32 of the cover members 31 provided at the upper and lower ends of the holding member 21, the waste heat transmitted from the substrate 18 of the LED illumination member 16 through the radiation ribs 48 can smoothly be radiated.

Moreover, since each LED element 17 constituting the illumination apparatus 15 as described above has a very long service life in comparison with a fluorescent lamp, a replacement work of the illumination becomes unnecessary. There is no need of a stock of change parts and a cumbersome work such as disposal of waste substances discharged by replacement.

In this embodiment, the LED illumination member 16 is somewhat inclined backward and vertically attached. However, the present invention is not limited to this example. The LED illumination member 16 may be attached parallel to the glass door 7 (laterally). Further in this embodiment, a reach-in type showcase has been described, but the present invention is not limited to that, and the illumination apparatus 15 may be adopted in, for example, an open showcase or the like.

What is claimed is:

1. A showcase, having at least one vertical pillar, in which the inside of a display chamber disposed in a main body is illuminated by an illumination apparatus, wherein the illumination apparatus includes at least two LED illumination members each having an LED element, and a holding member with a front surface attached to the main body, at the least one vertical pillar and extending there-along, hold holding the LED illumination members, and the holding member having a partition wall and having two holding portions being symmetrical in relation to the partition wall that extends along an axis in the center of the holding member in a direction perpendicular from the front surface towards the display chamber, includes each holding portion including a pair of reflector engagement portions, each having a reflector disposed thereon, one disposed on each side of the irradiation path of light from the LED element and are disposed away from each other as a distance from the LED element increases, and a lead wire receiving portion contained within each holding portion member to receive and a lead wire for supplying power to the LED illumination member received in the lead wire receiving portion.

2. The showcase according to claim 1, wherein the LED illumination member includes a plurality of LED elements arranged in a row, a shade is attached to the holding member at a position in an irradiating direction of light from the LED elements, and the shade has a wave-like sectional shape extending in the longitudinal direction of the row of the LED elements.

3. The showcase according to claim 2, wherein the LED illumination member includes a substrate provided with the plurality of LED elements on the surface thereof, the holding member is made of a metal, and the holding member is provided with radiation ribs which abut on positions corresponding to the backsides of the LED elements on the back surface of the substrate.

4. The showcase according to claim 2, wherein the sectional shape of a portion of the shade positioned at the end of the illumination apparatus is a wave-like shape which more noticeably refracts the light from the LED elements in the longitudinal direction of the row of the LED elements as compared with the sectional shape of the another portion of the shade.

5. The showcase according to claim 4, wherein the LED illumination member includes a substrate provided with the plurality of LED elements on the surface thereof, the holding member is made of a metal, and the holding member is provided with radiation ribs which abut on positions corresponding to the backsides of the LED elements on the back surface of the substrate.

6. The showcase according to claim 1, wherein the LED illumination member includes a substrate provided with the plurality of LED elements on the surface thereof, the holding member is made of a metal, and the holding member is provided with radiation ribs which abut on positions corresponding to the backsides of the LED elements on the back surface of the substrate.

* * * * *

UNITED STATES PATENT AND TRADEMARK OFFICE

CERTIFICATE OF CORRECTION

PATENT NO. : 8,057,061 B2
APPLICATION NO. : 12/370178
DATED : November 15, 2011
INVENTOR(S) : Atsuo Otsuki et al.

It is certified that error appears in the above-identified patent and that said Letters Patent is hereby corrected as shown below:

On the Title page:

Item "(73)" Assignee: "Sanvo Electric Co., Ltd., Moriguchi-shi, Japan"

Should read:

Item "(73)" Assignee: --Sanyo Electric Co., Ltd., Moriguchi-shi Japan--

Signed and Sealed this
Thirty-first Day of January, 2012

David J. Kappos

David J. Kappos
*Director of the United States Patent and Trademark Office*